US008745925B2

(12) United States Patent
Halfon et al.

(10) Patent No.: US 8,745,925 B2
(45) Date of Patent: Jun. 10, 2014

(54) COUPLING MECHANISM FOR SLIDING DOORS

(75) Inventors: Amos Halfon, Rishon le Zion (IL); Mordechai Harari, Rishon le Zion (IL)

(73) Assignee: Hardoor Top Design & Technology Ltd, Rishon le Zion (IL)

( * ) Notice: Subject to any disclaimer, the term of this patent is extended or adjusted under 35 U.S.C. 154(b) by 173 days.

(21) Appl. No.: 12/669,489

(22) PCT Filed: Jul. 24, 2008

(86) PCT No.: PCT/IL2008/001020

§ 371 (c)(1),
(2), (4) Date: Jan. 17, 2010

(87) PCT Pub. No.: WO2009/013747

PCT Pub. Date: Jan. 29, 2009

(65) Prior Publication Data

US 2010/0180506 A1 Jul. 22, 2010

(30) Foreign Application Priority Data

Jul. 26, 2007 (IL) ..... 184860

(51) Int. Cl.
*E05C 7/06* (2006.01)
*E05F 17/00* (2006.01)
*E05F 15/10* (2006.01)

(52) U.S. Cl.
USPC ..... 49/358; 49/118

(58) Field of Classification Search
USPC ..... 49/116, 118, 209, 358; 312/304
See application file for complete search history.

(56) References Cited

U.S. PATENT DOCUMENTS

| | | | | | |
|---|---|---|---|---|---|
| 2,144,782 | A | * | 1/1939 | Swanson | 49/130 |
| 2,755,081 | A | * | 7/1956 | Johnson et al. | 160/188 |
| 4,565,031 | A | * | 1/1986 | Sakamoto | 49/130 |
| 4,574,524 | A | * | 3/1986 | Bonetti et al. | 49/130 |
| 4,708,410 | A | * | 11/1987 | Mazaki | 312/138.1 |
| 4,913,214 | A | * | 4/1990 | Ming | 160/168.1 P |
| 4,930,256 | A | | 6/1990 | Kawanishi et al. | |
| 5,287,653 | A | * | 2/1994 | Young | 49/130 |
| 6,017,105 | A | | 1/2000 | Goughnour et al. | |

(Continued)

OTHER PUBLICATIONS

Search Report by the International Searching Authority (US) Dated Apr. 3, 2009.
Written Opinion of the Search Report by the International Searching Authority (US) Dated Apr. 3, 2009.

*Primary Examiner* — Katherine Mitchell
*Assistant Examiner* — Justin Rephann
(74) *Attorney, Agent, or Firm* — Knobbe Martens Olson & Bear LLP

(57) ABSTRACT

An automated coupling mechanism for sliding doors that are movably mounted upon a storage unit. The coupling mechanism may comprise a rotating mechanism comprising a rotating member, and connecting unit. The storage unit may comprise at least one outer sliding door and at least one inner sliding door comprising an upper track, where the connecting unit connect the rotating mechanism to the outer sliding door. The rotating member and the track may be made from material of substantially high friction coefficient to enable the rotating member to move the inner sliding door along the track when rotated. The connecting unit, which are connect the rotating mechanism to the outer sliding door, may enable the outer sliding door to move in the opposite direction of the inner sliding door, whereby the inner sliding door is moved by the rotating mechanism as a physical counteraction.

5 Claims, 4 Drawing Sheets

(56) References Cited

U.S. PATENT DOCUMENTS

| | | | | |
|---|---|---|---|---|
| 6,581,332 | B1 * | 6/2003 | Kim | 49/358 |
| 7,845,116 | B2 * | 12/2010 | Masuda | 49/223 |
| 2003/0188487 | A1 | 10/2003 | Rasmussen | |
| 2005/0000164 | A1 | 1/2005 | Jacobs | |
| 2006/0144529 | A1 | 7/2006 | Hemphill | |
| 2006/0237427 | A1 | 10/2006 | Logan | |
| 2008/0302016 | A1 * | 12/2008 | Halfon et al. | 49/130 |

* cited by examiner

Fig.
5

COUPLING MECHANISM FOR SLIDING DOORS

CROSS REFERENCE TO RELATED APPLICATION

This application is National Stage of International Application No. PCT/IL2008/01020, filed on Jul. 24, 2008 which in claims the benefit of U.S. Israeli Patent Application No. 184860, filed on Jul. 26, 2007, which is incorporated herein by reference.

FIELD OF THE INVENTION

The present invention relates generally to the field of apparatuses for sliding doors. More particularly, the present invention relates to automated mechanisms for coupling of sliding doors.

BACKGROUND OF THE INVENTION

The sliding doors mechanism is well known and commonly used in many utilities that require doors such as, for example, cabinets, closets, rooms and buildings entrances and so forth.

To allow doors to slide, each door is usually seated in a guiding-track where the door is enabled to slide through the track through bearings and/or rolling mechanisms such as wheels that slide along the track. To prevent the doors from clashing each other when passing by one another, the doors are usually seated and slide along different tracks where each track is positioned in a different plane where the planes are parallel.

The user may open each door by manually sliding the door along the guiding-tracks. The user may reach each side of a closet, for example, by manually coupling the doors and move the coupled assembly together to allow more closet space to open or be revealed.

The mechanism of sliding doors is extremely useful and convenient yet to manually slide the doors can be quite exhausting, especially after some usage-period when the doors can get off-track due to unbalanced sliding of the doors, accumulating dirt etc. The user cannot keep perfect balance of all doors' frame when sliding them in everyday use. Over the years or months, the tilting of the door inside the track caused by the imbalances when sliding, can damage the guiding-track's frame and the door may be tilted off-track and or be stuck inside the tracks and require a substantially fierce applying of physical force to slide the door.

SUMMARY OF THE INVENTION

According to embodiments, the present invention discloses an automated coupling mechanism for sliding doors. The coupling mechanism may enable coupling at least two sliding doors of a storage unit such as a closet, a cabinet and the like. The storage unit may comprise at least one outer sliding door and at least one inner sliding door, where the inner sliding door includes an upper track at the top surface of the inner sliding door. The sliding of the doors may be carried out by bearings connected to the doors and sliding along guiding-tracks seated at the top and bottom panels of the storage unit, as known in the art.

According to embodiments of the invention, the coupling mechanism may comprise at least one rotating mechanism comprising of a rotating member, and connecting unit that may connect the rotating mechanism to the outer sliding door.

According to some embodiments of the present invention, the rotating member may move (when rotating) the inner sliding door along the guiding-track and the connecting unit may enable the outer sliding door to automatically move in the opposite direction of the inner sliding door, whereby said inner sliding door is moved by said rotating mechanism.

To rotate the rotating member, the rotating mechanism may include an driver, which may be any electric or non-electric motor enabling to rotate the rotating member and/or operate other mechanical operations. A controller such as, for example, a remote control, which may be operatively associated with the rotating mechanism, may allow the user to shift positions of the doors from a closed position in which the doors are separated from one another (where the storage unit is closed) to a coupled open position in which the doors are congruent (where the storage unit is open).

The mechanical principle dominating this invention relies on the effect of a wheel-like member applying force upon a substantially flat surface where the friction between the surface of the wheel and the surface of the flat surface causes them to push one another in opposite directions.

According to some embodiments of the invention, the rotating member and the track of the inner sliding door may be made of materials of substantially high friction coefficient such as rubber, to enable pushing of the inner sliding door and the counteraction of moving of the rotating mechanism together with the outer sliding door in opposite direction. The movement of the rotating mechanism and the outer sliding door towards the opposite direction may be activated automatically as a counteraction to the rotating mechanism's pushing of the inner sliding door and the outer sliding door may automatically move along with the rotation mechanism since it is connected to it by the connecting unit.

According to some embodiments of the invention, the sliding doors may be additionally connected to an automated pushing mechanism. The pushing mechanism may enable

- pulling the outer sliding door into the substantially same plane as the plane of the inner sliding door in the closed position and
- to push the outer sliding door outwardly into a forward parallel plane to the plane of the inner sliding door,
- where the pushing and pulling may be enabled once the doors are separated meaning that the doors are not congruent.

Additionally, the rotating mechanism's driver may comprise a piston connected to the driver at one end and to the rotating member at the other end. The piston may enable to maintain the rotating member upon the track of the inner sliding door when the outer sliding door (connected to the rotating mechanism) is pushed forward as well as when the outer sliding door is pulled backwards by the pushing mechanism. An inner cylinder, connected to the rotating member, may be enabled (by the driver and mechanical structure) to move in and out of an outer cylinder to allow that adjustment, where the two cylinders may be coaxial and combine the piston.

The pushing mechanism may be any pushing mechanism known in the art. For example, a mechanism by Hardoor Mechanism Production LTD pending application number PCT/IL2006/001377 that discloses a system that includes at least an inner sliding door and outer sliding door movably coupled to corresponding guide rails. The guide rail that is coupled to the outer sliding door is selectably movable by a sliding door mechanism between a first and a second position. In the first position, a user can slide outer and inner sliding doors along the guide rails, whereas in the second position, a surface of the outer sliding door is substantially flush with a surface of the inner sliding door.

Additionally or alternatively, the coupling mechanism may further be integrated with an automated sliding mechanism that may be operatively associated with the controller. The sliding mechanism and the controller may enable the user to move the sliding doors along the guiding-tracks using the controller to position the doors at a desirable coupled open position along the guiding-tracks' horizontal axis. For that embodiment, the controller may further comprise directing switches enabling the user, for example, to push buttons with left and right arrows to direct the coupled assembly of the sliding doors.

Additionally or alternatively, the coupling mechanism may further comprise a sensing mechanism that may comprise at least one sensor that may enable identifying a user's position in relation to the storage unit front and open the inner and outer doors into a coupled open position where the open space of the storage unit faces the user and the coupled doors are substantially as far away from the user as possible by the length of the guiding-track.

According to some embodiments of the invention, the outer sliding door may too include a track at the top of the door to enable swapping inner and outer doors in case of the track's corrosion or for reconstructing symmetry reasons.

BRIEF DESCRIPTIONS OF THE DRAWINGS

The subject matter regarded as the invention will become more clearly understood in light of the ensuing description of embodiments herein, given by way of example and for purposes of illustrative discussion of the present invention only, with reference to the accompanying drawings, wherein FIG. 1 is a schematic illustration of an isometric view of a containing unit with an automated coupling mechanism in a closed position, according to some embodiments of the present invention.

The drawings together with the description make apparent to those skilled in the art how the invention may be embodied in practice.

An embodiment is an example or implementation of the inventions. The various appearances of "one embodiment," "an embodiment" or "some embodiments" do not necessarily all refer to the same embodiments. Although various features of the invention may be described in the context of a single embodiment, the features may also be provided separately or in any suitable combination. Conversely, although the invention may be described herein in the context of separate embodiments for clarity, the invention may also be implemented in a single embodiment.

DETAILED DESCRIPTIONS OF SOME EMBODIMENTS OF THE INVENTION

Figure 3:
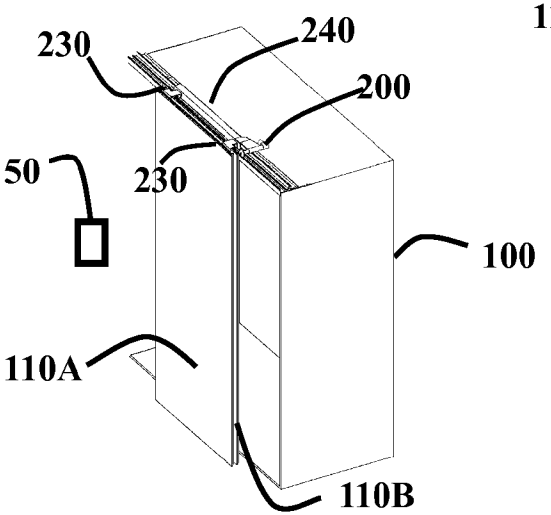
FIG. 3 is a schematic illustration of an isometric view of a containing unit with an automated coupling mechanism in an open position, according to some embodiments of the present invention.

The present invention discloses an automated coupling mechanism for sliding doors 110 that may enable coupling of sliding doors 110 of a storage unit 100 such as a closet, a cupboard, a cabinet a room's entrance and the like. The coupling of the doors 110 is defined herein as placing them in a substantially parallel and congruent position, as illustrated in FIG. 3. The coupled position or open position of the doors 110 may be more convenient for moving all storage unit's 100 doors together to view and access as many compartments or space in the storage unit 100 as possible.

The coupling mechanism may be mounted upon the storage unit 100 and fastened or attached to it by any attaching means known in the art.

Figure 4:
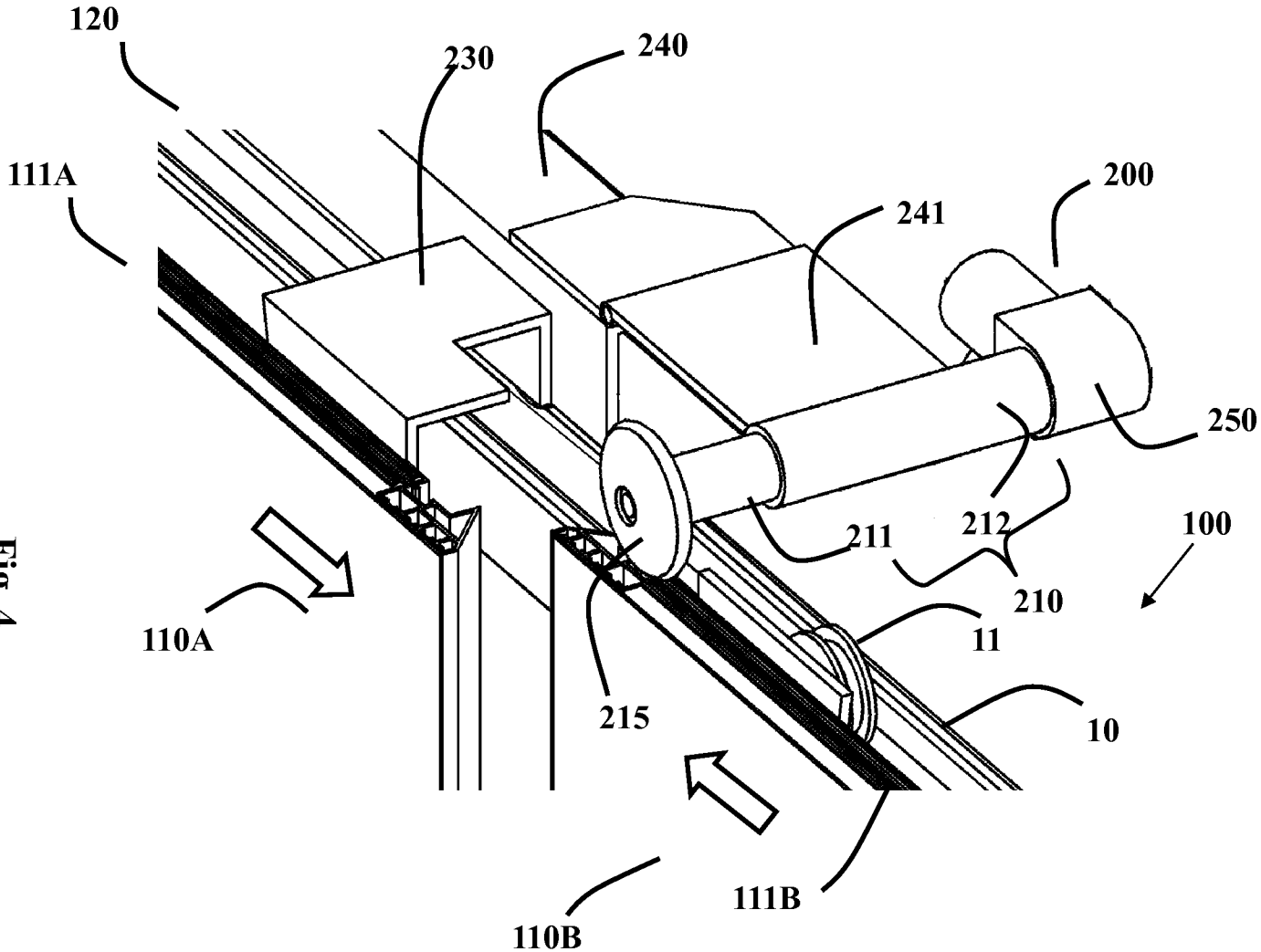
FIG. 4 is a schematic illustration of an automated coupling mechanism, according to some embodiments of the present invention.
Figure 5:
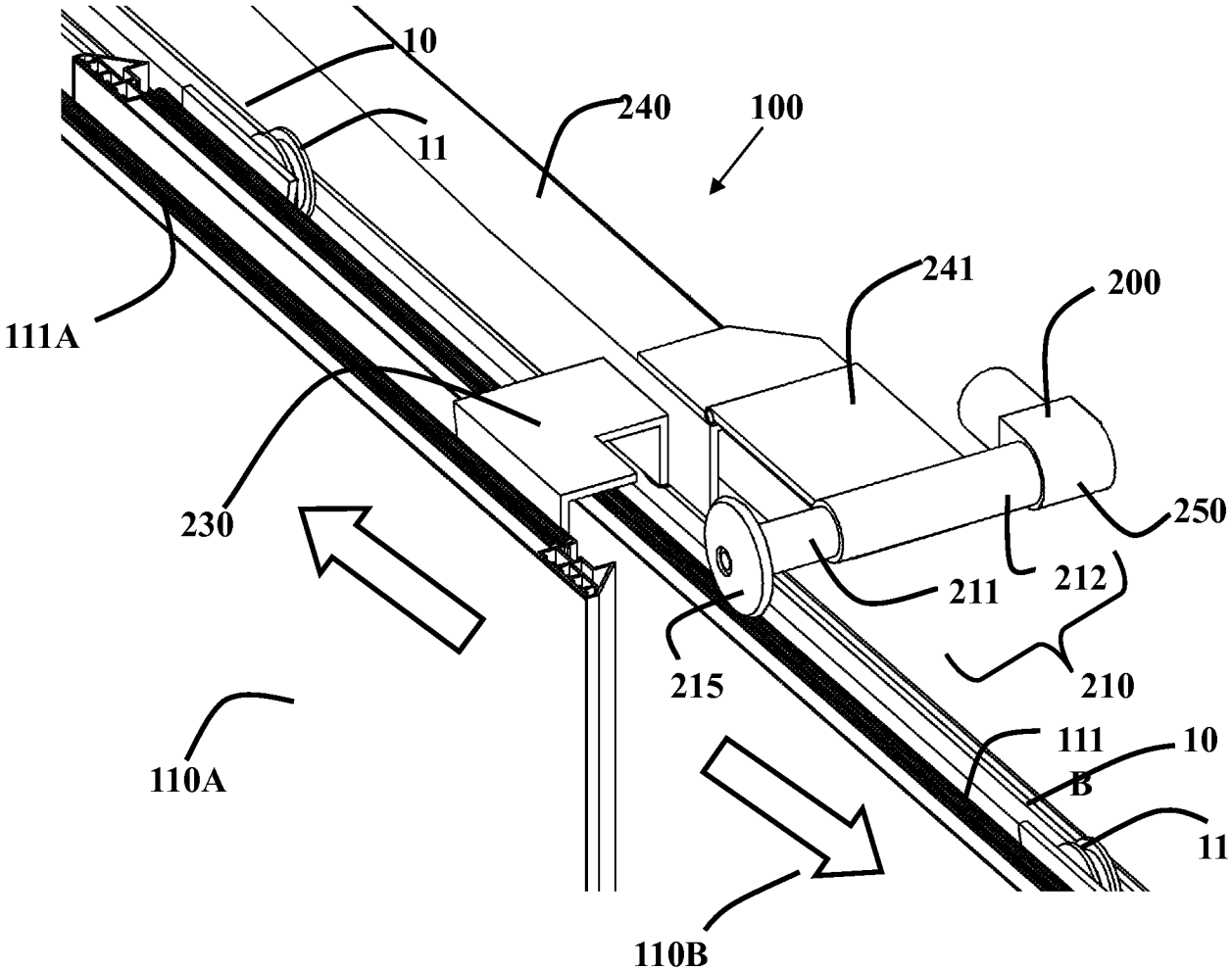
FIG. 5 is a schematic illustration of an automated coupling mechanism, according to some embodiments of the present invention.

The storage unit 100 may comprise at least one outer sliding door 110A and at least one inner sliding door 110B as illustrated in FIG. 4 and FIG. 5, where the inner sliding door 110B includes an upper track 111B seated at the top surface of the inner sliding door 110B.

According to embodiments of the invention, the coupling mechanism may comprise:

- at least one rotating mechanism 200 comprising a rotating member 215, and
- a connecting unit that may connect the rotating mechanism 200 to the outer sliding door 110A.

According to some embodiments of the invention, the rotating member 215 may enable moving the inner sliding door 110B along the track 111B and the connecting unit may enable the outer sliding door 110A to automatically move in the opposite direction of the inner sliding door 110B, whereby the inner sliding door 110B is moved by the rotating mechanism 200.

The mechanical principle dominating this invention relies on the effect of a wheel-like member applying force upon a substantially flat surface where the friction between the surface of the wheel and the surface of the flat surface causes them to push one another in opposite directions.

According to some embodiments of the invention, the rotating member 215 and the track 111B may be made of materials of substantially high friction coefficient such as rubber, to enable pushing of the inner sliding door 110B and the counteraction of moving of the rotating mechanism 215 together with the outer sliding door 110A in the opposite direction. The movement of the rotating mechanism 200 towards the opposite direction may be activated automatically as a counteraction to the rotating mechanism's 200 pushing of the inner sliding door 110B. The outer sliding door 110A may automatically move along with the rotation mechanism 200 since it is connected to it by the connecting unit.

While the description below contains many specifications, these should not be construed as limitations on the scope of the invention, but rather as exemplifications of the preferred embodiments. Those skilled in the art will envision other possible variations that are within its scope. Accordingly, the scope of the invention should be determined not by the embodiment illustrated, but by the appended claims and their legal equivalents.

Reference in the specification to "one embodiment", "an embodiment", "some embodiments" or "other embodiments" means that a particular feature, structure, or characteristic described in connection with the embodiments is included in at least one embodiments, but not necessarily all embodiments, of the inventions. It is understood that the phraseology and terminology employed herein is not to be construed as limiting and are for descriptive purpose only.

The principles and uses of the teachings of the present invention may be better understood with reference to the accompanying description, figures and examples. It is to be understood that the details set forth herein do not construe a limitation to an application of the invention. Furthermore, it is to be understood that the invention can be carried out or practiced in various ways and that the invention can be implemented in embodiments other than the ones outlined in the description below.

It is to be understood that the terms "including", "comprising", "consisting" and grammatical variants thereof do not preclude the addition of one or more components, features, steps, or integers or groups thereof and that the terms are to be construed as specifying components, features, steps or integers. The phrase "consisting essentially of", and grammatical variants thereof, when used herein is not to be construed as excluding additional components, steps, features, integers or groups thereof but rather that the additional features, integers, steps, components or groups thereof do not materially alter the basic and novel characteristics of the claimed composition, device or method.

If the specification or claims refer to "an additional" element, that does not preclude there being more than one of the additional element. It is to be understood that where the claims or specification refer to "a" or "an" element, such reference is not be construed that there is only one of that element. It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks. The term "method" refers to manners, means, techniques and procedures for accomplishing a given task including, but not limited to, those manners, means, techniques and procedures either known to, or readily developed from known manners, means, techniques and procedures by practitioners of the art to which the invention belongs. The descriptions, examples, methods and materials presented in the claims and the specification are not to be construed as limiting but rather as illustrative only.

Meanings of technical and scientific terms used herein are to be commonly understood as by one of ordinary skill in the art to which the invention belongs, unless otherwise defined. The present invention can be implemented in the testing or practice with methods and materials equivalent or similar to those described herein.

Any publications, including patents, patent applications and articles, referenced or mentioned in this specification are herein incorporated in their entirety into the specification, to the same extent as if each individual publication was specifically and individually indicated to be incorporated herein. In addition, citation or identification of any reference in the description of some embodiments of the invention shall not be construed as an admission that such reference is available as prior art to the present invention.

Figure 2:
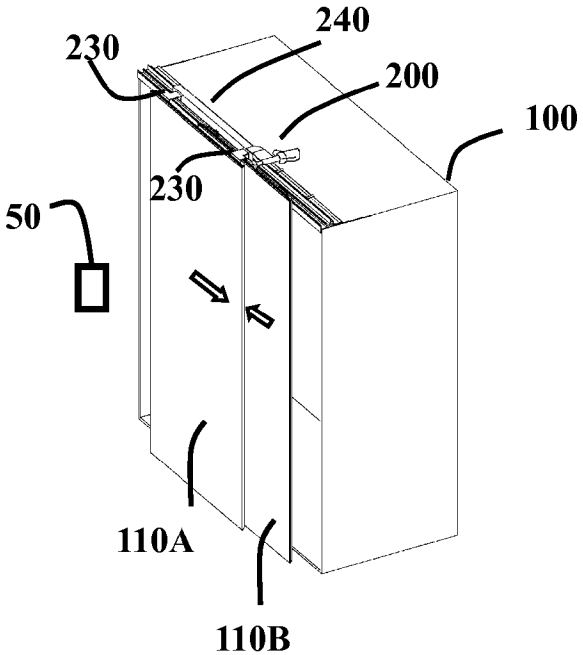
FIG. 2 is a schematic illustration of an isometric view of a containing unit with an automated coupling mechanism in a semi-open position, according to some embodiments of the present invention.
Figure 1:
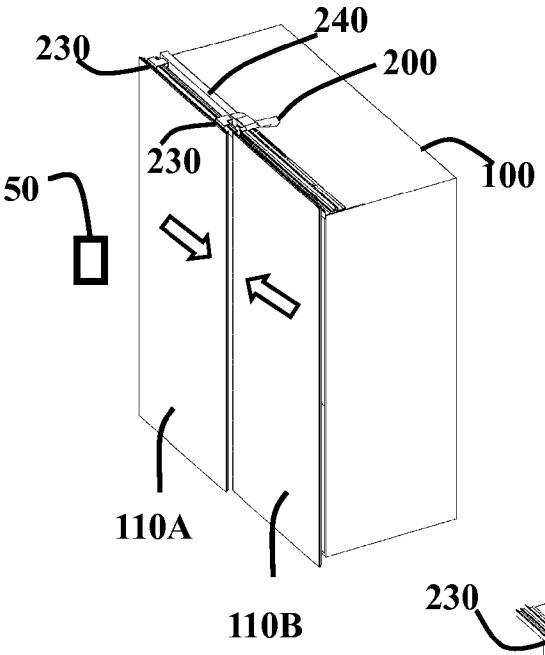

Reference is made to FIG. 1, FIG. 2 and FIG. 3, which schematically illustrate positions of the doors 110 of the storage unit 100 enabled by the coupling mechanism.

FIG. 1 is a schematic illustration of an isometric view of a storage unit 100 with an automated coupling mechanism in a closed position, according to some embodiments of the present invention.

FIG. 2 is a schematic illustration of an isometric view of a storage unit 100 with an automated coupling mechanism in a semi-open position, according to some embodiments of the present invention.

FIG. 3 is a schematic illustration of an isometric view of a storage unit 100 with an automated coupling mechanism in a coupled open position, according to some embodiments of the present invention.

According to some embodiments of the invention, the coupling mechanism may move the inner sliding door 110B in two directions along the guiding-track 111B meaning to the left or to the right by enabling to rotate the rotating member 215 to both clockwise and counterclockwise directions, as illustrated in FIG. 4 and FIG. 5.

Additionally, as illustrated in FIGS. 1, 2 and 3, the coupling mechanism may further comprise a controller 50 that may be operatively associated with the rotating mechanism 200 attached to the storage unit 100. The controller 50 may be, for example, a remote control and/or a switch that may have several control options such as "open", "close" or "on and "off", where the "open" or "on" option may automatically move the doors to a coupled position and a "closed" or "off" option may automatically move the doors to a separated position in which the doors have the substantially minimal coupled are.

FIG. 4 and FIG. 5 are schematic illustrations of an automated coupling mechanism, according to some embodiments of the present invention. The inner and outer sliding doors 110 may slide may be movably mounted upon the guiding-tracks 10 by bearings 11. The guiding-tracks 10 may be affixed or attached to the storage unit's 100 top and bottom panels or framing (FIGS. 4 and 5 only illustrate the top guiding-tracks 10 and bearings) where the bearings 11 may be affixed to bottom and top inner sides of the doors 110.

According to some embodiments of the invention, the rotating mechanism 200 may comprise a driver 250, at least one cylinder 211 and the rotating member 215 where the rotating member 215 may be connected to the cylinder 211 so that the central axis of the cylinder 211 may be the central axis of the rotating member 215.

According to embodiments of the invention, the driver 250 may be an electric motor enabling to rotate the rotating member 215.

According to some embodiments of the present invention, the rotating member 215 may be a wheel.

Additionally, the rotating mechanism 200 may be connected to the outer sliding door 110A through a connector 240 that may be attached to the cylinder 211 of the rotating mechanism 200 through a fastening piece 241 and to the outer sliding door 110A through at least two bridges 230. Each bridge 230 may comprise three walls and may be seated above the doors 110 to allow the inner sliding door 110B to pass through without colliding into the bridge 230 as illustrated in FIG. 5.

According to some embodiments of the invention, once a user presses a close option in the controller 50, for example, the driver 250 may automatically rotate the rotating member 215 enabling to move the inner sliding door 110B to the right, for example, by rotating counterclockwise and the outer sliding door 110A to the left consequently.

Figure 6:
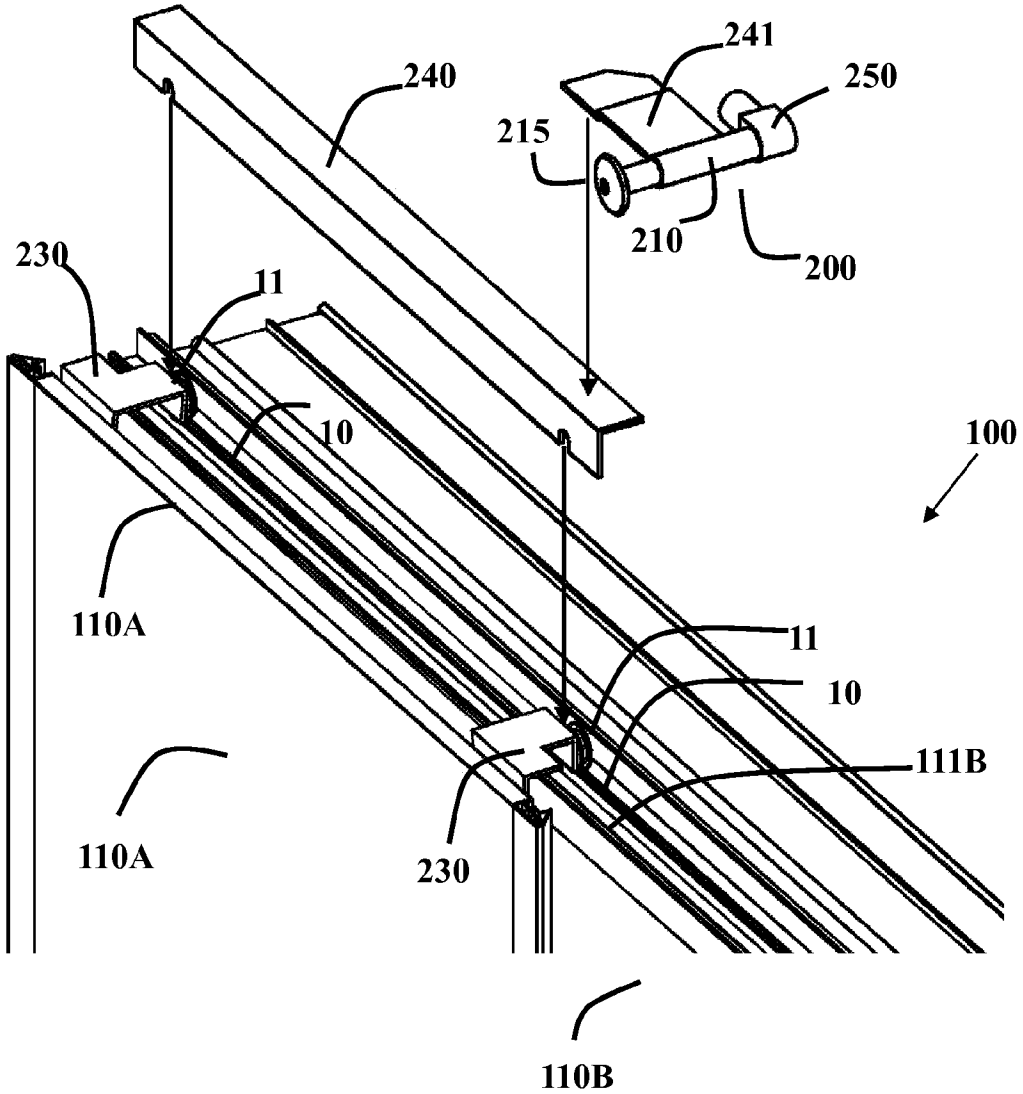
FIG. 6 is an exploded view of an automated coupling mechanism, according to some embodiments of the present invention.

FIG. 6 is an exploded view of an automated coupling mechanism, according to some embodiments of the present invention. The connector 240 may be constructed of a three walls shaped profile fastened to the bridges 230 at one sidewall and to the bearings 11 at the other sidewall by any fastening and connecting unit known in the art such as, screwing, welding, gluing, clipping and the like.

Additionally, the doors 110 may comprise attaching means enabling to attach the doors 110A and 110B to one another (once the doors 110 are already coupled) by any fastening and attaching means known in the art, to allow the user to slide the coupled doors 110 along the guiding-tracks 10 when the doors 110 are coupled, parallel and congruent. If the embodiment does not include the attaching means, the user may hold the coupled doors 110—manually attaching and sliding them together.

According to some embodiments of the invention, the sliding doors 110 may be additionally connected to an automated pushing mechanism. The pushing mechanism may enable

- pulling the outer sliding door 110A into the substantially same plane as the plane of the inner sliding door 110B to bring the doors 110 from an open position to a closed position; and
- to push the outer sliding door 110A outwardly into a forward parallel plane to the plane of the inner sliding door 110B, to bring the doors 110 from a closed position to an open position;
- where the pushing and pulling may be enabled once the doors 110 are separated meaning once the doors are not coupled or semi-coupled and do not congruent.

Additionally, the rotating mechanism 200 may comprise a piston 210 connected to the driver 250 at one end and to the rotating member 215 at the other end, as illustrated in FIG. 4 and FIG. 5. The piston 210 may enable to maintain the rotating member 215 upon the track 111B of the inner sliding door 110B when the outer sliding door 110A (connected to the rotating mechanism 200) is pushed forward as well as when the outer sliding door 110A is pulled backwards by the pushing mechanism.

Additionally, the piston 210 may comprise an outer cylinder 212 and an inner cylinder 211 where the inner cylinder 211 may be movably seated in the outer cylinder 212 such that the cylinders 211, 212 are coaxial. The inner cylinder 211 may be connected to the rotating member 215 and the driver 250 may enable the inner cylinder 211 to move along the cylinders' 211, 212 central axis in and out of the outer cylinder 212.

Additionally, the controller 50 may further be operatively associated with the pushing mechanism additionally to being operatively associated with the rotating mechanism 200. The controller 50 may allow shifting between the options of:

- closed position in which the doors 110 may be separate and seated substantially along the same plane;
- coupled open position in which the doors 110 may be seated at different parallel planes.

Once setting the controller 50 on the open position, the pushing mechanism may push the outer sliding door 110A forward into the parallel plane. Once setting the controller 50 on the closed position the pushing mechanism may pull the outer sliding door 110A backwards towards the plane of the inner sliding door 110B. The piston 210 may allow automatically adjusting the distance between the rotating member 215 and the driver 250 to maintain the rotating member 215 within the track 111B of inner sliding door 110B throughout the pushing and pulling movement of the outer sliding door 110A.

Additionally or alternatively, the coupling mechanism may further comprise an automated sliding mechanism that may be operatively associated with the controller 50. The sliding mechanism and controller 50 may enable the user to move the sliding doors 110 along the guiding-tracks 10 using the controller 50 to position the doors 110 at a desirable coupled position along the guiding-tracks' 10 horizontal axis. For that embodiment, the controller 50 may further comprise directing switches enabling the user, for example, to push buttons with left and right arrows to direct the coupled assembly of the sliding doors 110.

Additionally or alternatively, the coupling mechanism may further comprise a sensing mechanism that may comprise at least one sensor that may enable identifying a user's position in relation to the storage unit 100 front and open the inner and outer doors 110 into a coupled open position according to the user's position, where the open space of the storage unit 100 faces the user and the coupled doors 110 are substantially as far away from the user as possible by the length of the guiding-tracks 10 and/or at the farthest end of the storage unit 100.

According to some embodiments of the invention, the outer sliding door 110A may too include a track 111A at the top of the door 110A to enable swapping inner and outer doors 110 in case of the track's 111 corrosion or for any reconstruction and symmetry reasons.

While the invention has been described with respect to a limited number of embodiments, these should not be construed as limitations on the scope of the invention, but rather as exemplifications of some of the preferred embodiments. Those skilled in the art will envision other possible variations, modifications, and applications that are also within the scope of the invention. Accordingly, the scope of the invention should not be limited by what has thus far been described, but by the appended claims and their legal equivalents.

What is claimed is:

1. A coupling mechanism for sliding doors of a storage unit comprising at least one outer sliding door and at least one inner sliding door comprising at least one upper track, said coupling mechanism comprising:

- at least one rotating member configured for rotating along the upper track of said inner sliding door and engaging thereof;
- at least one driver operatively connected to said rotating member for rotating thereof;
- at least one bridge coupled to at least one wheel, said bridge connects to said outer sliding door and said wheel slides along an inner upper guiding-track of said storage unit; and
- a connector, which connects said bridge to said driver of said rotating member,
- wherein rotation of the rotating member along said upper track causes the inner sliding door and/or the outer sliding door to slide sideways in respect to the other sliding door,
- wherein said bridge, connector, rotating member and driver all connect to the outer sliding door and do not connect to the storage unit.

2. The coupling mechanism of claim 1, wherein said rotating member and/or the upper track of said inner sliding door over which said rotating member is rotated are made of materials of substantially high friction coefficient for having high friction between the surface of said rotating member and the upper track of the inner sliding door over which it slides.

3. The coupling mechanism of claim 2, wherein said material is rubber.

4. The coupling mechanism of claim 1, wherein said storage unit is a closet.

5. The coupling mechanism of claim 1, wherein said rotating member comprises a wheel.

* * * * *